US005170602A

United States Patent [19]

Ribic

[11] Patent Number: 5,170,602

[45] Date of Patent: Dec. 15, 1992

[54] FRAMED SURFACE COMPONENT, ESPECIALLY FOR FACADE CLADDING, AND PROCESS FOR INSTALLING IT

[76] Inventor: Walter Ribic, Hellerstrasse 34, 4600 Dortmund 50, Fed. Rep. of Germany

[21] Appl. No.: 689,816

[22] PCT Filed: Sep. 13, 1990

[86] PCT No.: PCT/DE90/00707

§ 371 Date: Jul. 8, 1991

§ 102(e) Date: Jul. 8, 1991

[87] PCT Pub. No.: WO91/04389

PCT Pub. Date: Apr. 4, 1991

[30] Foreign Application Priority Data

Sep. 18, 1989 [DE] Fed. Rep. of Germany ..... 3931053

[51] Int. Cl.[5] ..... E04B 5/52; E06B 3/64

[52] U.S. Cl. ..... 52/235; 52/476

[58] Field of Search ..... 52/171, 172, 306–308, 52/204, 206, 208, 783, 743, 475–477, 235; 49/501

[56] References Cited

U.S. PATENT DOCUMENTS 3,918,231 11/1975 Kessler ..... 52/476
4,333,282 1/1982 Medlin ..... 52/172
4,496,201 1/1985 Allgeyer ..... 49/501

FOREIGN PATENT DOCUMENTS 2509361 1/1983 France ..... 52/788
8701564 2/1989 Netherlands ..... 52/788

*Primary Examiner*—James L. Ridgill, Jr.
*Attorney, Agent, or Firm*—Michael J. Striker

[57] ABSTRACT

The framed surface component includes a surface component having circumferentially extending abutting surfaces provided with inwardly offset portions, L-shaped cross-sectioned frame legs enclosing the surface component circumferentially, each of the frame legs having one section leg engaging behind the surface component and another sections leg extending spaced from and parallel to a respective circumferentially extending abutting surface, and an adhesive connection between the surface component and the frame legs made with a hardening sealing compound. The sealing compound fills the offset portion in the abutting surfaces between the surface component and a free space between the surface component and the section legs of the frame legs, which section legs extend parallel to the abutting surfaces. The section legs extending parallel to the abutting surfaces of the surface component can each have a widened portion extending from a front side. The widened portions of the section legs extending parallel to the abutting surfaces of the surface component can each be provided with an undercut recess extending from the front side. A cover strip having an enlarged portion can be inserted into and engage in each of the undercut recesses by its enlarged portion in a positive-locking manner.

15 Claims, 3 Drawing Sheets

FRAMED SURFACE COMPONENT, ESPECIALLY FOR FACADE CLADDING, AND PROCESS FOR INSTALLING IT

BACKGROUND OF THE INVENTION

The invention is directed to a frame surface component, particularly for facade cladding, a process for producing the surface component, and facade cladding produced with the use of the surface component.

Surface components for facade cladding are known in various versions both with respect to construction and mounting. Some disadvantages of the previously known solutions consist in the considerable cost of manufacturing the surface components, especially when the latter are framed surface components, and in complicated mounting. The visual impression of the facade cladding formed by the surface components has also often given rise to criticism.

SUMMARY OF THE INVENTION

With this in mind, the invention is based on the need for a framed surface component, suited particularly for cladding of facades, which entirely avoids the disadvantages addressed above.

The object is met, according to the invention, with a framed surface component which is characterized in that the surface component, which is provided with an inwardly offset portion in the circumferentially extending abutting surfaces, is enclosed by a frame leg having an L-shaped cross section, one of whose section legs engages behind the surface component, while the other section leg extends at a distance from and parallel to the respective abutting surface of the surface component. The inwardly offset portion in the abutting surfaces of the surface component as well as the free space between the surface component and the section legs of the frame legs, which section legs extend parallel to the abutting surfaces, are filled with a hardening sealing compound bringing about an adhesive connection between the surface component and the frame legs, wherein the section leg of the frame legs which extends parallel to the abutting surfaces of the surface component is widened, extending from its front side, along a portion of its width so as to extend project into the section. In a further advantageous development, an undercut recess extends into the front side of this section leg, a cover strip which overlaps the front side of the section leg and the adjacent edge area of the surface component can be inserted into this undercut recess in a positive-locking manner by a enlarged portion which extends from it.

The angle section for the frame legs is easy to manufacture and deliberately avoids an overlapping of the visible surface of the filling. In particular, when the section leg of the frame legs which extends parallel to the abutting surfaces of the framed surface component is widened along a portion of its width extending from its front side so as to extend into the section, this contributes to a securing of the connection between the surface component and frame due to the positive locking engagement resulting from this, in addition to the adhesive connection. Another stabilizing element provided by the construction is the cover strip which is kept very narrow and which is snapped into the section leg of the frame legs which extends parallel to the abutting surface of the surface components.

Hook elements, which are provided at the rear of the section leg of the frame legs which engages behind the surface component, make it possible to hang the framed surface components in a on a supporting structure without difficulty. This preferably involves crosspieces which are attached to the masonry to be clad at intervals and are provided on the front side with receiving slots for the hook elements of the framed surface component. The hook elements forming a component part of the frame legs are advisably provided with a clamping surface sloping toward the base.

Every surface component is hung in a regular manner on two crosspieces. As a rule, two surface components which are arranged next to one another are then hung on a crosspiece, wherein the intermediate space between the surface components is bridged by the crosspiece, specifically its front wall. In order to bridge the surface components which are arranged one above the other at a distance from one another, connector pieces can be provided which project out of the section leg of the lower and upper frame leg which extends parallel to the abutting surfaces of the surface components. The connector pieces overlap one another when the surface components are hung. According to a special embodiment form, connector piece pairs which, by reciprocal formation of receptacles, receive one of the connector pieces extending from the frame leg of the adjacent surface component.

A sealing strip can be provided between the crosspiece and the adjoining frame leg, particularly a thermal insulation. This sealing strip can then also be provided with a shoulder which fits into the gap between the adjacent surface components, is constructed to correspond to the width of the gap and can further also has a hollow space extending along the length of the sealing strip. Further, for the purpose of good thermal insulation, sealing cords can be inserted into the receptacles for a connector piece which is provided between the horizontal frame legs and extends from the other respective adjacent frame leg.

Sealing strips can then also be placed behind the areas of the surface components by which the latter are supported at the frame legs, as well as the areas of the surface components at which the cover strips are supported. It is helpful when producing the framed surface components to use self-adhesive sealing strips.

As a whole, a visually appealing facade cladding with highly effective thermal insulation and also sound dampening can be produced at a comparatively low cost in connection with the production of the framed surface components and then also in connection with their mounting.

The method for producing the new framed surface component is effected in such a way that the surface component is first placed on the section leg of the frame legs which engages it from behind, possibly after attaching sealing strips to the frame legs beforehand. The surface component is then fixed to the frame legs, possibly after again attached sealing bonds to the surface component beforehand, by the cover strips which snap into the section legs of the frame legs extending parallel to the abutting surfaces of the surface component, and the hollow space between the frame legs. The surface component, which hollow space is formed by the offset portion in the surface component and the intermediate space between the surface component and the section legs of the frame legs extending parallel to the abutting surfaces of the surface component, is filled with hardening sealing compound, preferably a silicon sealing compound. The filling of the hollow space can be effected in an uncomplicated manner by applying the sealing compound to the hollow space via probes inserted through bore holes in the corner areas of the frame.

If the cover strips are omitted, the gap between the surface component and the section legs of the frame legs, which section legs extend parallel to the abutting surfaces of the surface component, must be temporarily sealed during the installation of the new surface component. The clamping effect resulting from the widened portion of the section legs of the frame legs extending parallel to the abutting surfaces of the surface component, which widening projects into the section of the frame legs, can also be brought about by means of a connection piece which is spaced from the front side of the section leg of the frame legs extending parallel to the abutting surface of the surface component, and extends into the section possibly until the offset portion in the abutting surfaces of the surface component.

Of course, the framed surface component can also be used in another way, e.g. as a screen, wherein it is hung on posts or supports taking over the function of the cross-ties. It is then also possible to use the framed multilayered glass panes, according to the invention, for window hinges and the like; of course, door or window frames can also be assigned. Other fillings can then be provided instead of the multilayered glass panes. If the thermal insulation is of primary importance, sandwich panels, among other things, can be provided for this.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE INVENTION

Figure 1:
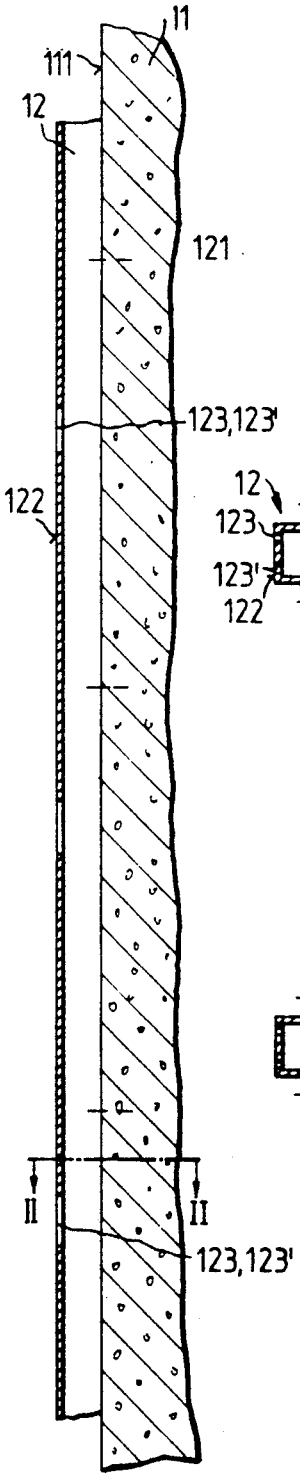
FIG. 1 is cutaway vertical cross-sectional view through an outer wall to be clad with the new surface component.
Figure 2:
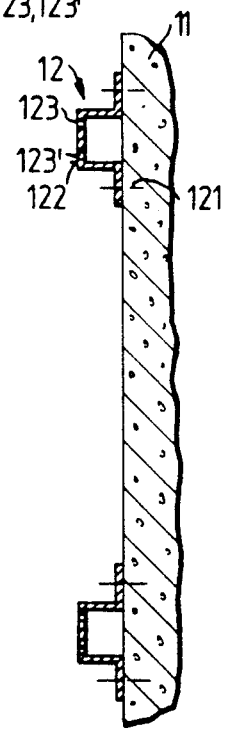
FIG. 2 is a cutaway cross-sectional view according to line II—II in FIG. 1.
Figure 4:
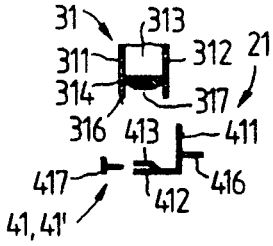
FIG. 4 is an exploded, cutaway, cross-sectional view according to line IV—IV in FIG. 3.
Figure 3:
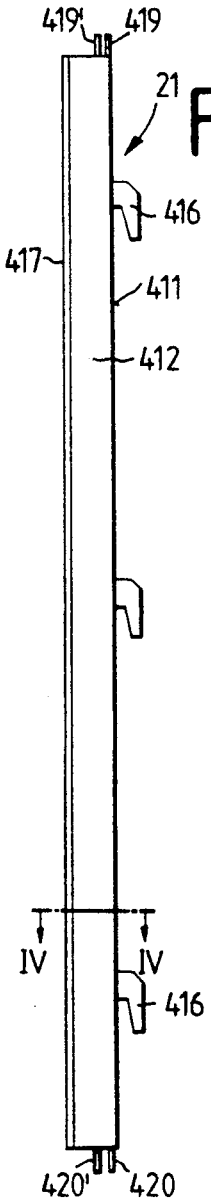
FIG. 3 shows a side view of the surface component, according to the invention, which is to be assigned to the facade in FIG. 1.
Figure 5:
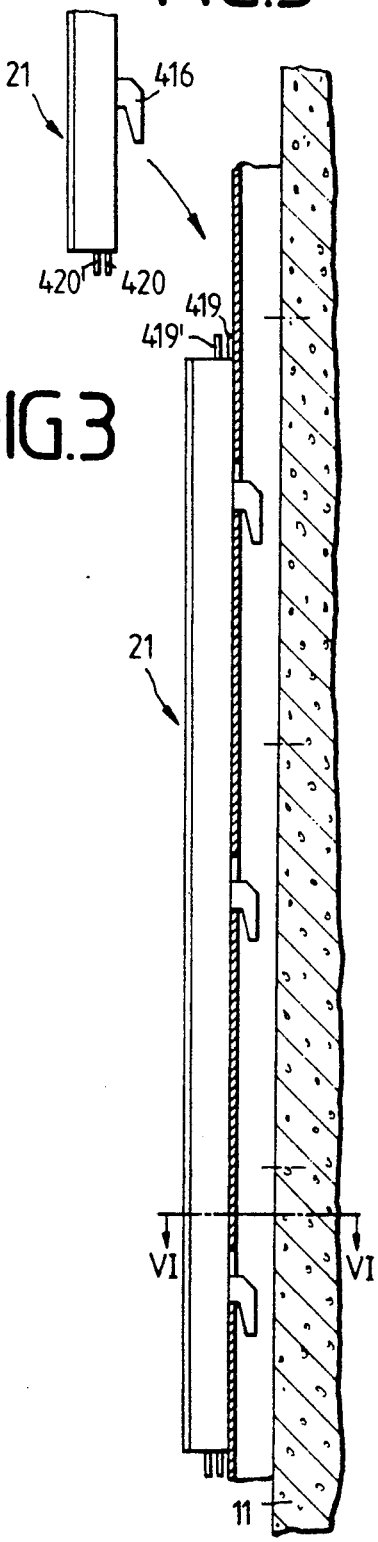
FIG. 5 shows the wall shown in FIG. 1 with surface components mounted on it or to be mounted on it.

An outer wall whose facade 111 is to be clad with surface components, according to the invention, is designated by 11. For this purpose, crosspiece 12 having a hat-shaped cross-section are fixed (121) at the wall 11 at intervals corresponding to the width of the surface components in the illustrated example. Receiving slots 123, 123' (FIG. 4) for hooks located on the rear side of the surface components to be hung on the crosspiece 12 are located on the front side 122 of the crosspiece 12. The surface components 21 are hung on the crosspiece 12 next to one another and one above the other, specifically on every two adjacent crosspiece 12. Two adjacent surface components 21 are hung on every crosspiece.

The surface component 21 comprises a frame and the filling enclosed by the frame, in the present case a double-glass pane 31, whose connecting members 314, which connect the panes 311 and 312 and hermetically seal the intermediate space 313 between the panes, are shifted inward accompanied by the formation of an inwardly offset portion 317 at the abutting surfaces 316 of the double-glass pane. The double-glass pane 31—hereinafter filling—is enclosed by a frame comprising frame legs 41, 41', 41'' and 41''' which have an L-shaped cross-section and engage behind the filling 31 with a leg 411, the other leg 412 extending at a distance from and parallel to the abutting surfaces 316 of the filling 31. The leg 412 extending parallel to the abutting surfaces 316 of the filling 31 is widened (413) along a portion of its width proceeding from its front side so as to project into the section. An undercut recess 414 extends into this widened portion 413 extending from the front side, the cover strip 417 can be snapped into this recess 414 with an enlarged portion 418 The frame legs 41, 41', 41'' and 41''' are identical to this extent.

As regards the frame legs 41 and 41' extending in the vertical line, their legs 411 which engage behind the filling 31 are correspondingly provided at their outer side, i.e. the side facing away from the filling 31, with means for hanging the framed surface component 21. These means are hooks 416 formed on at, respectively, coped or notched out of the section legs 411, the surface components being hung by means of the hooks 416 at the crosspieces 12 forming the supporting construction by introducing the hooks 416 into the receiving slots 123, 123' in the crosspieces 12, which receiving slots 123, 123' are provided for this purpose. It is provided on the one hand that every surface component 21 is hung at two adjacent crosspieces 12 and, on the other hand, two adjacent surface components 21 are hung at every crosspieces 12 while leaving open a gap X.

The hook elements are not required in the case of the horizontal frame legs 41'' and 41''' extending between the vertical frame legs 41 and 41'; of course, they are constructed differently in such a way that the legs 412'' and 412''' extending parallel to the abutting surfaces 316 of the filling 31 are provided with connector piece pairs 419, 419' and 420, 420' which project out from the outer side and form recesses in a reciprocal manner and are offset relative to one another, so that when the surface components 21 to be arranged one above the other are mounted in such a way that a connector piece of one frame leg is inserted into the receptacle of the other frame leg, the planar configuration of the visible surface formed by the surface components 21 is ensured. The height of the webs 419–420' proceeding from the horizontal frame legs 41'' and 41''' and the assignment of the hooks 416 to the vertical frame legs 41 and 41' and the positioning of the receptacle slots 123, 123' in the crosspieces 12 are adapted to one another in such a way that the gaps X formed between surface components which are hung next to one another and between surface components which are hung one above the other correspond.

Figure 6:
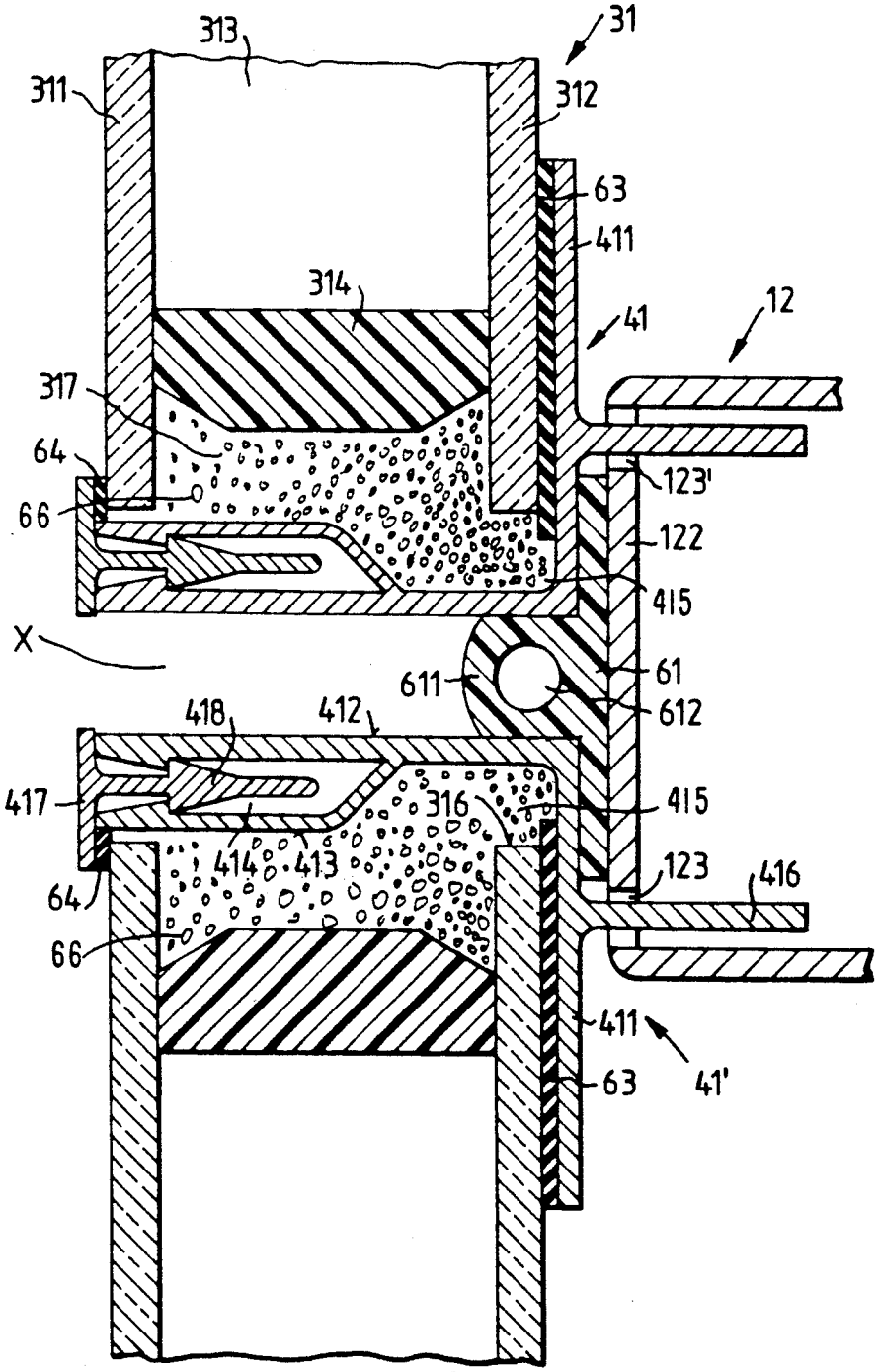
FIG. 6 is a horizontal cross-sectional view through the surface component and crosspieces shown in FIG. 5 taken according to line VI—VI in FIG. 5.
Figure 7:
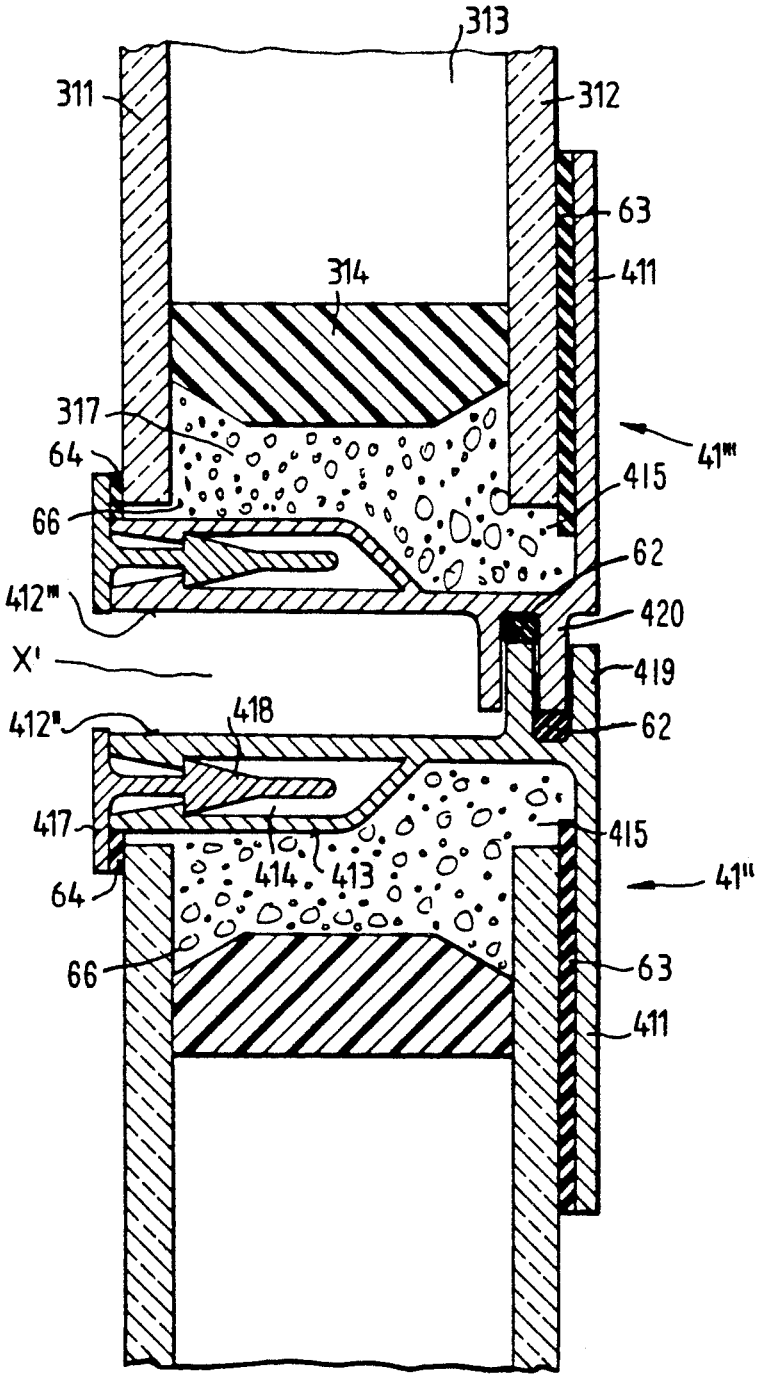
FIG. 7 is a cross-sectional view through the horizontal abutting area between two surface components arranged one above the other.

For the purpose of good thermal insulation, sealing strips 61 are inserted, according to FIG. 6, between the facing surfaces of the section legs 411 of the vertical frame legs 41 and 41' engaging behind the filling 31, which facing surfaces adjoin the crosspieces 12, and the crosspieces 12. The sealing strips 61 are provided with a shoulder 611 projecting into the gap X between the surface components 21 arranged adjacent to one another, which shoulder 611 has a hollow space 612 extending along the length of the strip 61. A sealing function can also by provided by sealing cords 62 which are inserted in receptacles formed by the connector pieces 419, 419' and 420, 420' extending from the section legs 412'' and 412''' of the horizontal frame legs 41'' and 41''', which section legs 412'' and 412''' extend parallel to the abutting surfaces of the filling 31. A thermal insulation and sound dampening effect also results when, as is shown, the section leg 411 engaging behind the filling 31 is covered with a sealing band 63 and a sealing band 64 is inserted between the cover strip 417 and the surface of the filling 31 overlapped by it. If the sealing bands 63 and 64 are self-adhesive on both sides, the fitting of the framed surface component is facilitated.

The framed surface component is produced, according to the invention, in such a way that the section legs 411 of the frame legs 41 to 41''' are covered with sealing bands 63 and joined together to form the frame. Subsequently, the filling, the double-glass pane 31 in this specific case, is inserted into the frame by being placed on the frame legs. The cover strips 417 are then attached to the frame legs 412 while inserting the sealing bands 64. The hollow space 415 remaining between the frame legs and the double-glass pane, including the offset 317, is then filled with hardening silicon sealing compound 66 which provides a permanent adhesive connection between the frame legs 41–41''' and double-glass pane 31. The filling is effected by probes which are inserted through the frame legs 41–41''', preferably in the corner areas of the frame, into the free space between the frame legs 41–41''' and the double-glass pane.

While the invention has been illustrated and described as embodied in a framed surface component, especially for facade cladding, and process for installing it, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt if for various applications without omitting features that, from the standpoint of prior art, fairly constitute essential characteristics of the generic or specific aspects of this invention.

What is claimed is new and desired to be protected by Letters Patent is set forth in the appended claims.

I claim:

1. Framed surface component, particularly a framed multilayered glass pane, comprising:

a surface component having an abutting surface provided with an inward offset, a plurality of frame legs each having an L-shaped cross section and two section legs, one of the section legs extending behind the surface component and the other of the sections legs extending spaced from and parallel to abutting surface and having an offset, and an adhesive connection between the surface component and the frame legs, said adhesive connection comprising a hardening sealing compound, said sealing compound filling the offset in the abutting surface of the surface component, said offset of the other section leg and a free space formed between the surface component and the other section leg extending parallel to the abutting surfaces and thereby providing the adhesive and positive locking connection between the surface component and the frame legs.

2. Framed surface component according to claim 1, wherein said hardening sealing compound is a silicon sealing compound.

3. Framed surface component according to claim 1, wherein the section legs extending parallel to the abutting surfaces of the surface component each have a width and a widened portion extending from a front side along a portion of the width of the section leg.

4. Framed surface component according to claim 3, wherein the widened portions of the section legs extending parallel to the abutting surfaces of the surface component are each provided with an undercut recess extending from the front side, and further comprising a plurality of cover strips each having an enlarged portion, each of said cover strips being inserted into and engaged in one of the undercut recesses engaged by the enlarged portion in a positive-locking manner, said cover strip being structured to overlap a portion of the section leg and an adjoining edge portion of the surface component.

5. Framed surface component according to claim 1, further comprising mounting means in the form of a plurality of hooks provided on the section legs of the vertical frame legs which engage behind the surface component, said mounting means being provided on a side of the section legs facing away from the surface component so that the hooks can engage in receptacles provided in supporting structures behind the surface component, said supporting structures being arranged one above the other and spaced from each other.

6. Framed surface component according to claim 5, wherein the hooks are provided with clamping surfaces.

7. A plurality of the framed surface components according to claim 1 arranged one above the other and adjacent each other to form a facade cladding, wherein said section leg of an upper horizontal frame leg of a lower one of said framed surface components, said section leg engaging behind the surface component of the lower framed surface component, projects beyond the other section leg of the upper horizontal frame leg of the lower framed surface component toward an adjacent higher one of said framed surface components to form a connector piece, and another adjacent connector piece projects from the other section leg of the upper horizontal frame leg of the lower framed surface component and is spaced therefrom to form a receptacle, and wherein the section leg of the lower horizontal frame leg, said section leg extending parallel to the respective abutting surface of the surface component of the adjacent higher framed surface. component, is provided with an additional connector piece spaced from the other section leg of the lower horizontal frame leg, and a further connector piece is provided spaced from the additional connector piece so as to form another receptacle, so that said additional connector piece of said lower horizontal frame leg engages in the receptacle formed between the connector pieces of the section leg of the upper horizontal frame leg of the lower frame surface component.

8. The framed surface components according to claim 7, further comprising a sealing cord placed in a bottom portion of the receptacles.

9. A facade cladding comprising a plurality of vertical crosspieces spaced a distance from each other; and a plurality of the framed surface components according to claim 8 arranged side-by-side horizontally, each of said crosspieces being positioned adjacent a vertical one of the frame legs of one of the framed surface components, and a sealing strip inserted between a facing surface of the crosspiece and the section legs of the vertical frame legs engaging behind the surface components.

10. The facade cladding according to claim 9, wherein the sealing strip inserted between the crosspiece and adjacent vertical frame legs of adjacent framed surface components is provided with a shoulder inserted in a gap formed between the adjacent vertical frame legs.

11. The facade cladding according to claim 10, wherein the shoulder projecting into the gap is provided with a hollow space extending along a length of the sealing strip.

12. A method of making a framed surface component, comprising the steps of providing a surface component having an abutting surface with an inward offset, arranging a plurality of frame legs each having an L-shaped cross-section and two section legs so that one of the section legs extends behind the surface component and the other of the section legs extends spaced from and parallel to the abutting surface of the surface component and has an offset, and forming an adhesive and positive locking connection between the surface component and the frame legs by filling a hardening sealing component into the offset in the abutting surface of the surface component, into the offset of the other section leg and also into a free space formed between the surface component and the section leg extending parallel to the abutting surface.

13. A method according to claim 12, and further comprising the steps of covering the one section legs which extend behind the surface component with a sealing strip, placing the surface component on the one section legs covered with the sealing strip, covering a portion of the surface component to be placed on the one section leg with a sealing band, attaching the sealing bands and the surface components to the frame legs so as to fix the surface component in the frame legs.

14. A method according to claim 12, wherein said filling includes inserting probes into the space between the frame and the surface component through bore holes provided at corners of the frame legs and filling the sealing compound by the probes.

15. A method according to claim 12, wherein said inserting includes inserting the probes into the free space between the surface component and the frame legs at the onset of the filling and continuously withdrawing them during the filling.

* * * * *